United States Patent [19]

Anderson et al.

[11] 4,384,797

[45] May 24, 1983

[54] SINGLE LAMINATED ELEMENT FOR THERMAL PRINTING AND LIFT-OFF CORRECTION, CONTROL THEREFOR, AND PROCESS

[75] Inventors: Clifford W. Anderson; Hugh T. Findlay, both of Lexington; Nancy C. Watkins, Frankfort, all of Ky.

[73] Assignee: International Business Machines Corporation, Armonk, N.Y.

[21] Appl. No.: 292,552

[22] Filed: Aug. 13, 1981

[51] Int. Cl.[3] ..... B41J 29/16

[52] U.S. Cl. ..... 400/696; 400/120; 400/240.1; 400/241.1

[58] Field of Search ..... 400/118, 120, 240.1, 400/241, 241.1, 696

[56] References Cited

U.S. PATENT DOCUMENTS

| | | | |
|---|---|---|---|
| 3,744,611 | 7/1973 | Montanari et al. | 400/120 |
| 3,825,437 | 7/1974 | Blair | 400/241.1 X |
| 3,825,470 | 7/1974 | Elbert et al. | 400/241.1 X |
| 3,855,448 | 12/1974 | Hanagata et al. | 400/120 X |
| 3,924,728 | 12/1975 | Brown et al. | 400/696 |
| 3,998,314 | 12/1976 | Barouh et al. | 400/696 |
| 4,034,843 | 7/1977 | Newman et al. | 400/240.1 |
| 4,093,772 | 6/1978 | Taylor et al. | 400/696 X |
| 4,103,066 | 7/1978 | Brooks et al. | 400/118 X |
| 4,320,170 | 3/1982 | Findlay | 400/241.1 X |
| 4,329,071 | 5/1982 | Applegate et al. | 400/120 |
| 4,329,075 | 5/1982 | Applegate et al. | 400/120 X |
| 4,345,845 | 8/1982 | Bohnhoff et al. | 400/120 |

FOREIGN PATENT DOCUMENTS

| | | | |
|---|---|---|---|
| 16320 | 10/1980 | European Pat. Off. | 400/241 |
| 56-21874 | 2/1981 | Japan | 400/120 |
| 56-46774 | 4/1981 | Japan | 400/120 |
| 2010515 | 6/1979 | United Kingdom | 400/241.1 |

OTHER PUBLICATIONS

IBM Technical Disclosure Bulletin, "Color Thermal--Transfer Printing", Edgar et al., vol. 23, No. 7A, Dec. 1980, pp. 2633–2634.

IBM Technical Disclosure Bulletin, "Tackified Correctable Inks", Anderson et al., vol. 23, No. 12, May 1981, p. 5461.

*IBM Technical Disclosure Bulletin,* vol. 19, No. 2, Jul. 1976, p. 672, entitled "Delayed Tack Ribbon for Laser Transfer and Other Printing", by C. A. Bruce and C. E. Stratton.

*IBM Technical Disclosure Bulletin,* vol. 23, No. 5, Oct. 1980, p. 2021, entitled "Electrothermal Ribbon Path", by S. L. Applegate, H. W. Ham, J. J. Molloy and W. F. Voit, Jr.

*Primary Examiner*—Ernest T. Wright, Jr.
*Attorney, Agent, or Firm*—John A. Brady

[57] ABSTRACT

A ribbon (22) in thermal printing has an outer layer (50) which adheres to printed characters at somewhat elevated temperatures but is non-tacky at room temperatures. The embodiment has an active layer of an ethylene vinyl acetate copolymer, an acrylic polymer, and carbon black. Thermal printing is conducted from the preferred ribbon by setting the switch (44) for heating to temperatures higher than the lift-off temperature. Lift-off is accomplished by returning to the printing position of the error and setting the switch (44) for lower voltage to the printing electrodes (9). The guide (29) allows cooling so that the bond is set before the ribbon (22) is pulled away.

17 Claims, 7 Drawing Figures

SINGLE LAMINATED ELEMENT FOR THERMAL PRINTING AND LIFT-OFF CORRECTION, CONTROL THEREFOR, AND PROCESS

CROSS-REFERENCE TO RELATED APPLICATION

In U.S. application Ser. No. 292,553, filed on the same day as this application by Steven L. Applegate, James J. Molloy and Donald A. Walker as inventors, entitled Ribbon Guiding For Thermal Lift-Off Correction, and assigned to the same assignee as this application is assigned, an improvement on this invention is described, the improvement being the ribbon guide and related mechanism, which is herein described somewhat generally.

TECHNICAL FIELD

This invention relates to lift-off correction of thermal printing.

Thermal printing of the kind involved is in the nature of non-impact typewriting. Printing is by flow of melted material from a transfer medium which appears similar to a one-use typewriter ribbon. A lower lamination of the ribbon is heated, and printing is achieved by transferring ink from the ribbon to paper by means of local heating. In an embodiment in which the lower lamination is resistive, the ribbon is contacted, for example, with point electrodes and a broad area contact electrode. The high current densities in the resistive layer at the point electrodes during an applied voltage pulse produce intense local heating which causes transfer of ink from the ribbon to a paper in contact with the ribbon. Lift-off correction is the physical stripping of a printed character from the paper or other surface on which it is printed.

BACKGROUND ART

Lift-off correction of printing by conventional typewriters is now a standard option. To achieve such correction, the cohesion of the ink in a printed character must be greater than the affinity of the ink in the character for the paper or other surface upon which it is printed. The ink is formulated so that the adhesion is one of surface adhesion between the ink and the paper rather than a viscous penetration of the paper fibers or wetting of the paper fibers with the ink layer. With such ink as the printing material, correction of erroneously typed characters is accomplished by adhesive removal from the surface of the image sheet or paper, using a piece of material having an adhesive surface, where the adhesive surface is impacted onto the erroneously typed letter. This adheres the adhesive surface of the correction material to the character, and the adhesive element is pulled from the paper, thereby pulling the erroneously typed character bodily with it. This now-standard lift-off correction with conventional typewriters is illustrated by U.S. Pat. Nos. 3,825,437 to Blair and 3,825,470 to Elbert et al. Numerous other prior art to the same general effect might be cited, but such additional teachings are considered cumulative at most because they do not involve thermal printing.

Conventionally, the character erroneously typed is the character once again impacted during lift off erasure. This form of impact minimizes adhesion to the paper surrounding and in internal uninked parts of the character. Abrasion and other marking of the paper is thereby minimized.

Thermal printing of the kind here involved is known and described in the prior art, but is presently very much less common than conventional impact typing. U.S. Pat. No. 3,744,611 to Montanari is illustrative the basic printing system and U.S. Pat. No. 4,103,066 to Brooks et al. describes a ribbon with a polycarbonate resistive layer for thermal printing. Neither of these patents mentions correction of erroneously printed characters. *IBM Technical Disclosure Bulletin*, Vol. 23, No. 5, (October 1980) page 2012, "Electrothermal Ribbon Path," by S. L. Applegate et al. discloses thermal printing in which the ribbon is directed away from print area while still warm so as to minimize adhesion to the ribbon after printing found to occur with cooling.

A non-tacky roll is easier to feed and otherwise handle within the typewriter, and reduction and elimination of tack in a lift-off correction ribbon except during the correction step is now a commonly recognized design objective. U.S. Pat. No. 3,855,448 to Hanagata et al. and *IBM Technical Disclosure Bulletin*, Vol. 19, No. 2, (July 1978), page 672, "Delayed Tack Ribbon for Laser Transfer and Other Printing," by C. A. Bruce et al., both are to thermal printing and both describe their transfer layer as an adhesive material which is non-adhesive until the temperature is raised during printing. Neither have any mention of lift-off correction. In U.S. Pat. No. 4,093,772 to Taylor et al. and U.S. Pat. No. 3,924,728 to Brown et al. a lift-off correction tape is part of the typewriter ribbon and is said to be non-tacky during feeding. The coating in these patents is said to be not sticky to touch and not adherent to itself, but to become sticky in response to pressure, specifically the pressure of impact typing. U.S. Pat. No. 3,998,314 to Barouh et al. is to the same general effect, but describes the lift-off layer only as impact compressible.

Typically, in the prior art the lift-off correction tape is fed by mechanisms separated from the imaging ribbon feed mechanisms. Desirable aspects of a combined or single ribbon feed are recognized. Thus, the above-mentioned U.S. Pat. Nos. 4,093,772 and 3,924,728 show a dual ribbon with lengthwise strips, one of marking material and one of lift-off correction material. This is said to be a conventional split correction ribbon with a lift-off coating rather than a masking coating. The normally non-tacky nature of the lift-off strip is said to make possible the feeding and handling of the dual ribbon by a single mechanism in the typewriter. U.S. Pat. No. 4,034,843 to Newman et al. similarly discloses a split, lift-off correction-imaging ribbon for impact typing, with emphasis on techniques of joining the two strips.

DISCLOSURE OF THE INVENTION

As mentioned in the foregoing prior art, non-tackyness, except at the lift off step, not only simplifies the feeding of a correction tape, but simplifies incidental handling and, should the correction material dislodge into the printer, the material does not tend to stick to important areas and is generally more easily cleaned away. It is an important advantage of this invention that a normally non-tacky lift-off correction element for use in a thermal printer is provided. It is a related advantage of this invention that a lift-off correction element for use in a thermal printer which feeds well with low drag is provided. More specifically, a lift-off correction element for use in a thermal printer which exhibits tack only at temperatures above normal handling and feed temperatures is provided.

It is another important advantage of this invention, that a lift-off correction element for use in a thermal printer which does not require separate mounting and feed mechanisms is provided. More specifically, a thermal printer employs a lift-off correction element which is also the imaging ribbon such that only a single ribbon element functions for correction and imaging.

Such advantages are achieved by providing a thermal printer and related process to heat a ribbon at one temperature to effect printing and at an intermediate temperature to effect lift-off correction.

In accordance with the present invention, a lift-off correction element is provided which is non-tacky at ordinary temperatures and which exhibits tack at elevated temperatures below the melting point of the ink to be lifted off. Properly selected thermoplastic materials may implement this invention.

The latently tacky material may be a single ingredient, but the desired properties are usually achieved with a blend. Satisfactory results can be expected from a combination of a thermoplastic resin, such as a polyamide, with a compatible, normally highly viscous material, such as gum rosin. Similarly, satisfactory results can be expected from the combination of two similar thermoplastic materials having low and intermediate softening points. The lift-off correction material is coated on a substrate, which serves as a physical support and as a source of heat. Specifically, the substrate may be a dispersion of conductive carbon black in polycarbonate of a thickness in the order of magnitude of 15 microns.

The printer has the capability of generating heat in the image of the character to be erased. This capability is used and the thermal activation of the adhesive corresponds in form to the ink image of the character. This minimizes adhesion to the paper surrounding and internal to the character, thereby minimizing subsequent abrasion or other marking of the paper. This advantage corresponds to conventional erasure by impact printing, in which the printing element for the character to be lifted off is the one impacted against the paper as a part of correction. Correction by this thermal technique is largely noiseless as it involves no impact or abrasion.

In accordance with the embodiments of this invention, the correction ribbon is actually the marking ribbon. No separate ribbon feed or handling mechanism is required. The outer material is appropriately colored and melts at one temperature to thereby flow to a paper or other surface with which it is in contact. That same material is selected to become tacky at a temperature level between the printing temperature and room temperature. This dual-function ribbon requires only a single mechanism to handle the ribbon and to generate heat in a pattern, with the reduced temperatures being by a direct reduction of energy to the heating elements.

In practice the printer is backed over the erroneous character, the intermediate heat is applied, and the heated area is allowed to cool so that the bond sets before the ribbon is moved away from the printing plane. Movement during correction may beneficially be slower than the corresponding movement during printing.

BRIEF DESCRIPTION OF THE DRAWING

The printing system and ribbon of this invention are illustrated in a representative form by the drawing.

BEST MODE FOR CARRYING OUT THE INVENTION

Figure 1:
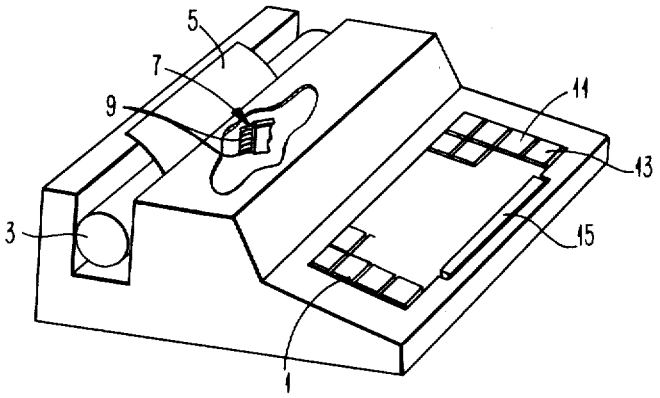
FIG. 1 shows an illustrative typewriter system.

As shown illustratively in FIG. 1, the printer is a typewriter having the usual keyboard 1, a platen 3 upon which paper 5 to be printed upon is supported and a thermal printing element or printhead 7 with a group of small electrodes 9 to effect printing of a selected character image. Selection of individual electrodes 9 as the printhead 7 is moved across the paper 5 makes possible the combination of minute dots of image which can be combined to form virtually any image.

One of the keybuttons 11 effects ordinary backspacing while another keybutton 13 effects the erasure operation to be described. Another key 15 effects forward spacing. Sequencing and other control of typewriter operations in response to operation of keyboard 1 is under control of electric logic and digital processing systems as is now conventional in general respects in electronic typewriters (for example, see U.S. Pat. No. 4,345,845 to Bohnhoff et al. for a printer control).

In FIG. 1 the printhead 7 is shown broken away on the side toward the keyboard 1. The remaining structure is sufficiently indicated in FIG. 2. Toward the platen 3, the supporting structure of printhead 7 is shown broken away to emphasize the single vertical row of electrodes 9 which are mounted within the printhead 7. During normal printing each electrode 9 is either connected to printing potential or not connected, depending upon the pattern to be printed.

Figure 2:
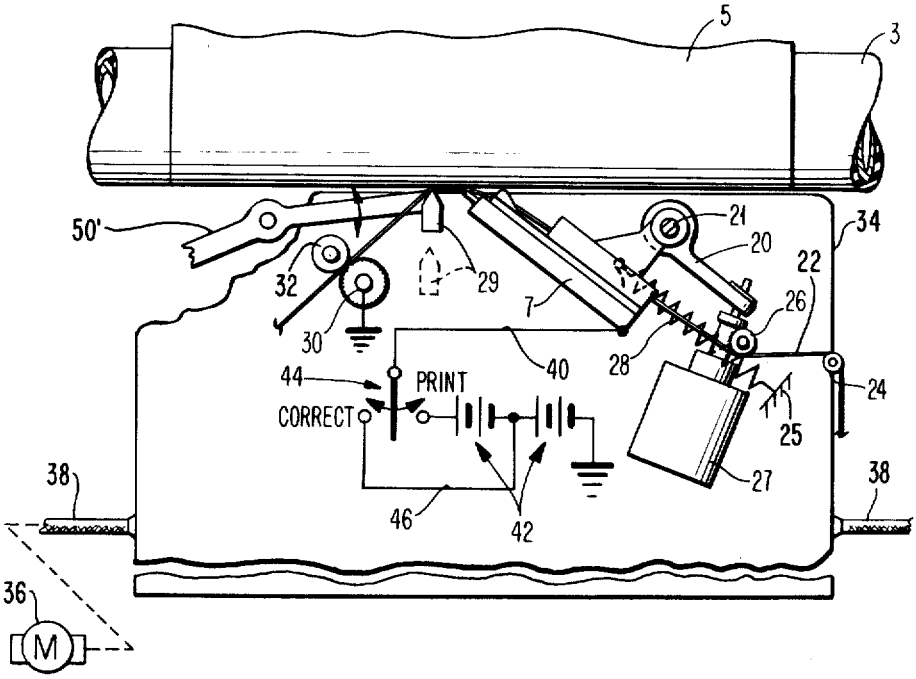
FIG. 2 shows a top view of such a system including the ribbon.

FIG. 2 is a top view, also generally illustrative only, of the printing and erase area. Positioning member 20, pivoted at point 21, is attached to printhead 7. A ribbon 22 is unwound from a supply spool (reel 114 in U.S. Pat. No. 4,329,075 to Applegate et al. is illustrative) around tensioning roller 24, across a guide roller 26, and to the end of printhead 7. Solenoid 27 is linked to an arm of positioning member 20, and, when energized as shown in FIG. 2, pulls member 20 clockwise to force the end of printhead 7 against paper 5 mounted on platen 3. When solenoid 27 is de-energized, spring 28, connected to member 20 and to a point on the mechanism frame 25, pulls member 20 counterclockwise to thereby move printhead 7 away from paper 5.

Ribbon 22 is pressed between the end of printhead 7 and paper 5 when solenoid 27 is activated. Ribbon 22 is then in contact with the ends of the vertical column of electrodes 9 (FIG. 1), which are mounted in printhead 7. A guide member 29 is selectably movable toward and away from platen 3. During correction guide member 29 is moved toward platen 3 to present a face at paper 5 a distance selected to be about 6 millimeters prior to the printing position. When member 29 is in the erase position, shown in FIG. 2, ribbon 22 is thereby positioned flat with the paper 5 at the printing point and for about 6 mm prior to the printing point. In a typical printing operation 6 mm is about the width of two to four characters.

Metering of the ribbon 22 is effected by cooperating metering rollers 30 and 32 located on the take-up side of printhead 7. Roller 30 is arranged on the side of the ribbon 20 that faces printhead 7 and is mounted at a fixed position with respect to printhead 7. Firm pressure contact with ribbon 22 is achieved by mounting roller 32 such that it is movable toward roller 30 and biased to provide a nipping force. Roller 30 is driven with each printing operation an amount approximately equal to the width of printing movement effected, so that the printhead 7 moves across paper 5 with unused ribbon 22 opposite the printing position and with the ribbon 22 having no substantial motion in the direction of printing movement relative to paper 5.

Roller 30 is formed of a conducting material such as brass and is preferably knurled to assure intimate contact and firm gripping. Current from the electrodes 9 in printhead 7 is collected by the electrically grounded roller 30 through contact with the side of the ribbon 22 which it contacts, which side is resistive as will be more fully discussed. To improve the connection further, roller 32 may be grounded and used to establish a connection through voids in the ink layer left by printing.

Such operation and design of a thermal printer may be conventional, except for the guide member 29. Typically, the printhead 7 and ribbon-guide rollers 24, 26, 30 and 32 are mounted on a carrier 34 which moves across the length of a stationary platen 3. The guide member 29 may similarly be mounted on carrier 34, along with a suitable mechanism 50' to move it toward platen 3 during correction. For movement across the print line, carrier 34 is attached to an electrical motor 36, which drives a belt or cable 38, the ends of which are connected to opposite sides of carrier 34.

An electrical lead, shown illustratively as a single wire 40, connects the electrodes 9 (FIG. 1) of printhead 7 to an electrical power source or power supply 42.

A switch 44 has two positions, a print position at which the full potential of power supply 42 is connected to the electrodes 9 and a correct position of which a connection is made to line 46 which results in a portion of the power of supply 42 being applied to the electrodes 9. These electrical elements and connections are shown entirely illustratively as they may be implemented by a vast number of entirely acceptable alternatives within the skill of the art involved.

Figure 3:
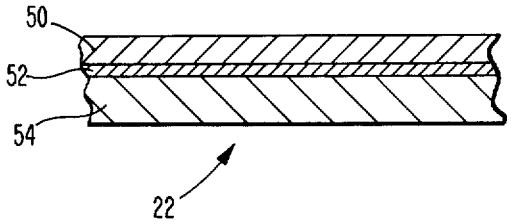
FIG. 3 shows an intermediate section of the preferred ribbon from the side.

As shown in FIG. 3, the ribbon 22 is a three layer element of an active material 50 of typically 4 to 6 microns in thickness, a 1000 Angstrom in thickness aluminum layer 52 which serves as current return path, and a resistive substrate 54 of typically 15 microns in thickness. The ribbon 22 is, of course, wide enough to fit across the entire vertical row of electrodes 9.

Since printing is by complete release, ribbon 22 must be incremented with each printing step. Printing is effected by energizing selected ones of the electrodes 9 while those electrodes 9 are in contact with substrate 54. Substrate 54 is also in contact with a broad, conductive area of roller 30, which disperses current beyond the location of electrodes 9. The high current densities in the areas near the energized point electrodes 9 produce intense local heating which causes, during printing, melting of active material 50 and resulting flow onto the paper 5. During printing guide member 29 is away from platen 3 so that the ribbon 22 is pulled away from paper 5 while still hot. During lift-off correction, guide member 29 is moved to paper 5 so that ribbon 22 is held against paper 5 in the span between printhead 7 and guide member 29. During lift-off correction, as will be explained, the electrical potential and corresponding current is reduced, to thereby cause a heating which brings out adhesion without flow of the character printed.

The fabrication and the specific form of the resistive substrate 54 forms no essential part of this invention and any substrate with adequate physical and electrical characteristics may be employed. Polycarbonate is used as the resin material of the substrate of the preferred embodiment. A representative teaching of the fabrication of a polycarbonate substrate for this purpose is disclosed in the above-mentioned U.S. Pat. No. 4,103,066. Three parts of a polycarbonate resin (which may be Mobay Chemical Corporation Merlon or Makrolon or mixtures thereof and with a smaller amount of General Electric Co. GE3320 a polycarbonate block copolymer) is dissolved in approximately 93 parts of dichloromethane. Added to this mixture is approximately one part of conductive carbon (XC-72 from Cabot Corporation). This is first mixed in a shaker and then dispersed in a ball-mill jar containing steel balls. The dispersion is reverse roll coated onto a 5 mil Mylar substrate to the desired dry thickness. (Mylar is a trademark of DuPont for polyethylene terephthalate.) The solvent is then evaporated away.

An electrically conducting intermediate layer 52 of aluminum of 1000 Angstrom thickness is vacuum deposited upon this substrate 54. The aluminum is then overcoated using a reverse roll coater by a dispersion of the material of the active layer, the preferred embodiment being the aqueous formulation described below, to the desired dry thickness. Upon evaporation of the water vehicle, the combined polycarbonate layer with aqueous-coated layer is stripped from the Mylar substrate. This is the final ribbon 22, with active material 50 being the water-applied layer, and the polycarbonate with carbon black being the substrate 54. It is slit to the desired width and wound onto a spool.

ACTIVE LAYER FORMULATION

The following formula is the presently preferred formula for the active or marking layer 50. It yields the desired printing characteristics of being bodily releasable from paper 5 while being non-tacky at ordinary ambient temperatures, flowable to effect printing at high temperature, and developing adhesion or tack for printed characters at intermediate temperatures.

Active Layer Formula

| Component | Parts by Weight | % Solids |
|---|---|---|
| Adcote 37JD610 | 6 | 73.4 |
| (An ethylene vinyl acetate copolymer of 6300 weight average molecular weight; approximately 90% by weight being the polyethylene component; with about 6% by weight rosin acids as dispersants; 40% total solids in water; trademark product of Morton Chemical Co.) | | |
| Hycar 2600X120 | 1 | 15.3 |
| (Polyethylacrylate, with about 4% by weight polyacrylonitrile, some dispersant; 50% solids in water; trademark product of B. F. Goodrich Chemical Co.) | | |
| Aquablack 140 | 1 | 11.3 |
| naphthalene sulfonic acid dispersant; 37% solids in water; trademark product of Bordon Chemical, Division of | | |

-continued

| Active Layer Formula | | |
|---|---|---|
| Component | Parts by Weight | % Solids |
| Bordon Inc.) | | |
| Water (distilled, additional to water in foregoing) | 1 | — |

LIFT-OFF ERASURE OPERATION

Upon discovery by the operator of a character which is incorrect, lift-off correction is effected by first positioning the printhead 7 to act as in printing at the location of the incorrect character. In FIG. 4, the character "b" in the bottom of the two lines of printing shown is to be corrected. Printhead 7 is shown as being on the same line as that character. If not, the platen 3 is rotated to select the line.

Figure 4A:
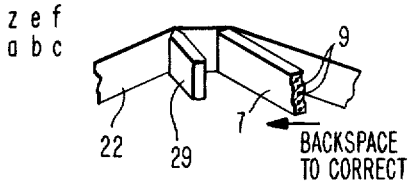
FIG. 4*a* through FIG. 4*d* show steps in an erasure operation.
Figure 4B:
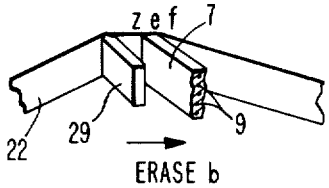
Figure 4C:
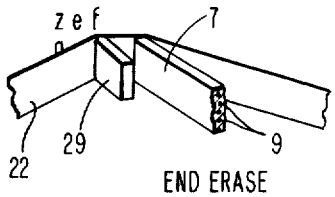
Figure 4D:
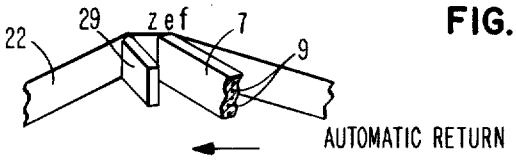

In the status shown in FIG. 4*a*, printhead 7 is on the desired line and has moved past the "b." Backspace key 11 is then operated until the printhead 7 is positioned to print at the location occupied by the "b," this position being shown in FIG. 4*b*. Backspacing is then terminated and the machine operator depresses the erase key 13. (The relationship of the static position with respect to printing in a typical system is optional, since the machine may be designed to move left initially so as to achieve a steady operating speed. Thus, it is a matter of choice whether printhead 7 should be positioned over the "b" or some location in a predetermined relationship to the "b.")

Depression of erase key 13, followed by the key on keyboard 1 for "b," the symbol to be erased, effects the operations of normal printing of "b" with five exceptions as follows in the specific embodiment being described. (In a memory-assisted embodiment, the char- to be erased would be known automatically, so no key on keyboard 1 for that character need be depressed after erase key 13 is depressed.)

(1) Guide member 29 is brought to the position near platen 3.

(2) Current to electrodes 9 is reduced. In the simplified and largely symbolic illustration of FIG. 2, switch 44 is brought to the leftward position, thereby contacting line 46 and providing only a part of the potential of power supply 42 to the electrodes 9.

(3) The speed of movement of printhead 7 and, correspondingly, movement of ribbon 22 may be reduced. However, speed reduction is not necessary with the specific embodiment disclosed and the same speed as printing is employed to simplify machine requirements.

(4) Print movement is across the character being corrected and for 6 more millimeters, the electrodes 9 not being powered after being powered to form the "b" to be erased. A typical location upon termination of the erase operation is suggested in FIG. 4*c*. The extra space provides a delay for cooling prior to the peeling of ribbon 22 with the erased character attached from the page. And, (5) Printhead 7 may be automatically returned to a position for printing in the now-clean space previously occupied by the "b." A character desired in that space may be printed by depressing the key associated with it. Printhead 7 may be moved forward at any time by operating space key 15, or by operating other keys of keyboard 1 as is conventional.

PARAMETERS OF THE EMBODIMENTS

It will be recognized that the specific parameters are interdependent and that selection of one in a specific implementation can be as desired so long as the other parameters have corresponding characteristics. Thus, a thicker ribbon 22 tends to require higher current at electrodes 9, although an active layer 50 which melts easily might negate this. Such adjustments are simply a matter of ordinary optimization of design.

Accordingly, the parameters to be mentioned are those of one embodiment as described and should be considered basically illustrative, rather than particularly significant to any embodiment. The normal printing current at each electrode 9 is 26 milliamperes (ma). During lift-off correction the current to each electrode 9 is 6–12 ma. The speed of movement of printhead 7 during normal printing is 2½ inches (6.35 cm) per second. When the speed of movement of printhead 7 is reduced during lift-off correction, a typical speed is 1½ inches (3.81 cm) per second. Return of printhead 7 after correction uses ordinary printer capabilities. The 6 mm span between printhead 7 and guide member 29 was the result of available space in the specific implementation and might desirably be less in other embodiments.

MECHANISM OF LIFT-OFF

During the erasure operation the ribbon 22 is held in contact with printing on paper 5 after the initial heating. This is accomplished by guide member 29, which is then contiguous to paper 5, as is the end of printhead 7. Accordingly, the intermediate head for erasure is applied, but the ribbon 22 stays in contact with paper 5 for the time of printing movement through about 6 mm, at which point ribbon 22 clears member 29 and is directed away from paper 5 toward the nip of rollers 30 and 32 (FIG. 2).

This period of contact with the character to be lifted-off permits a bond to be formed between the outer layer 50 of ribbon 22 and the printed character. No such bond is observed if ribbon 22 is pulled away immediately after the application of the intermediate heat. The bond is therefore dependent upon both the heating and the cooling.

The lower level of heat supplied during erasure does not cause layer 50 of ribbon 22 to flow, but does produce an affinity or tack toward the printed character, which is, of course, of the same material since the characters are printed from the same ribbon 22. The subsequent cooling sets the adhesive bond.

It is known from experience that correction is sometimes facilitated using the disclosed embodiment when movement during correction is slower than movement during printing. This is not thought to be fundamental to the mechanism of all suitable implementations in accordance with this invention. The slower movement provides added time, and cooling time is known to be needed for the bond for correction to set. Also, the slower movement results is a less vigorous pulling away when ribbon 22 does clear member 29 and is pulled away from paper 5. These and other such factors would not necessarily be significant in other implementations.

It will be apparent that the essential characteristics of these blends may be realized or, in the future, exceeded by other materials and blends. Similarly, the physical structure involved may take a multitude of forms, but all within the spirit and scope of the invention as herein described. Special purpose modifications might be employed with this basic invention, such as the incorporation of an agent slowly operative on paper 5 to produce a permanent mark, after which undetectable lift-off correction is not possible. Accordingly, patent coverage should not be limited by the specific embodiments herein disclosed, but should be as provided by law, with particular reference to the following claims.

What is claimed is:

1. A laminated element for thermal printing and correcting said printing by lift-off correction comprising an electrically resistive supporting substrate carrying an active layer flowable at temperatures substantially above ordinary room temperatures to effect said thermal printing, said active layer being pigmented for visual recognition when printed and being a thermoplastic which is non-tacky and cohesive at ordinary room temperatures and which forms a bond for lift-off correction of thermal printing made by said active layer of said element after having been raised to temperatures above ordinary room temperatures and below said temperatures at which said thermal printing by said element is effected.

2. The laminated element as in claim 1 in which said substrate is a solid polymer with conductive particles dispersed throughout said substrate.

3. The laminated element as in claim 1 in which said active layer is a blend comprising an ethylene vinyl acetate copolymer, a compatible acrylic polymer, and carbon black.

4. The laminated element as in claim 1 in which said active layer and said substrate are separated by an aluminum layer of thickness in the order of magnitude of 1000 Angstrom.

5. The laminated element as in claim 4 in which said substrate is a solid polycarbonate polymer with conductive particles dispersed throughout said substrate.

6. The laminated element as in claim 5 in which said active layer is a blend of about 69 parts by weight ethylene vinyl acetate copolymer, about 15 parts by weight of a compatible acrylic polymer, and about 11 parts by weight carbon black.

7. A thermal printer having a power source to power heat-producing elements which can be selectably activated in the form of a character to be printed while in contact with a thermal transfer medium from which marking material flows when heated by said elements wherein the improvement comprises keyboard selection means to select a lift-off correction mode of operation, and means operative during said lift-off correction mode of operation to apply power from said power source to said thermal transfer medium in a substantial amount, said amount being less than power to effect said printing, while activating selected ones of said elements.

8. A thermal printer as in claim 7 wherein said elements are activated in the form of the character being erased.

9. A thermal printer as in claim 7 also comprising a mechanism operative on said transfer medium during said correction to modify ribbon feed from ribbon feed during printing to allow said marking material to form a bond with said character being erased subsequent to said applying of power for lift-off correction.

10. A thermal printer as in claim 8 also comprising a mechanism operative on said transfer medium during correction to modify ribbon feed from ribbon feed during printing to allow said marking material to form a bond with said character being erased subsequent to said applying of power for lift-off correction.

11. The process of correcting a printed image which has been thermally printed from a transfer medium having an active layer which transfers to a receiving substrate under heat and a backing layer which can be heated in the form of a character to effect said transfer comprising the steps of (1) positioning an unused portion of said transfer medium over a character printed by said transfer medium, then (2) heating said backing layer until the active layer develops an adhesion to said character while not flowing from said transfer medium then (3) allowing, said active layer to cool until a bond forms between said character and said active layer, and then (4) moving said transfer layer away from the location at which said character is printed to lift said character away.

12. The process as in claim 11 in which said heating is done in the pattern of the character to be corrected.

13. The process as in claim 11 in which said moving said transfer layer during correction is at a speed substantially slower than the corresponding movement during printing.

14. The process as in claim 11 in which said active layer is pigmented for visual recognition when printed and is a thermoplastic which is non-tacky and cohesive at ordinary room temperatures.

15. The process as in claim 14 in which said heating is done in the pattern of the character to be corrected.

16. The process as in claim 15 in which said active layer is a blend comprising an ethylene vinyl acetate copolymer, a compatible acrylic polymer, and carbon black.

17. The process as in claim 16 in which said moving said transfer layer during correction is at a speed substantially slower than the corresponding movement during printing.

* * * * *